US006174152B1

(12) United States Patent
Rokman et al.

(10) Patent No.: US 6,174,152 B1
(45) Date of Patent: Jan. 16, 2001

(54) DISPLACEMENT PUMP AND METHOD OF USE THEREOF

(75) Inventors: Kay Rokman; Raine Suurnakki, both of Karhula (FI)

(73) Assignee: Ahlstrom Paper Group Oy, Helsinki (FI)

( * ) Notice: Under 35 U.S.C. 154(b), the term of this patent shall be extended for 0 days.

(21) Appl. No.: 09/048,184

(22) Filed: Mar. 26, 1998

(30) Foreign Application Priority Data

Feb. 26, 1998 (FI) ..... 980436

(51) Int. Cl.[7] ..... F01C 1/18
(52) U.S. Cl. ..... 418/206.1; 418/94
(58) Field of Search ..... 418/206.1, 94

(56) References Cited

U.S. PATENT DOCUMENTS

| | | | | |
|---|---|---|---|---|
| 3,716,449 | | 2/1973 | Gatward et al. . | |
| 3,871,952 | | 3/1975 | Robertson . | |
| 4,400,147 | | 8/1983 | Springer et al. . | |
| 4,534,717 | * | 8/1985 | McCabe et al. | 418/206.1 X |
| 4,621,994 | | 11/1986 | Ellis . | |
| 4,913,629 | | 4/1990 | Gifillan . | |
| 4,986,739 | | 1/1991 | Child . | |
| 5,154,149 | | 10/1992 | Turner . | |
| 5,318,415 | | 6/1994 | Verhoeven . | |
| 5,318,425 | | 6/1994 | Jetzer et al. . | |
| 5,451,149 | * | 9/1995 | Profaca et al. | 418/94 |
| 5,567,140 | | 10/1996 | Dodd . | |

FOREIGN PATENT DOCUMENTS

| | | |
|---|---|---|
| 15 28 963 | 9/1970 | (DE) . |
| 7-39803 | 2/1995 | (JP) . |

* cited by examiner

*Primary Examiner*—Hoang Nguyen
(74) *Attorney, Agent, or Firm*—Nixon & Vanderhye P. C.

(57) ABSTRACT

A displacement pump for a relatively high pressure performance environment includes a casing with first and second ends, with rotors driven in the casing to effect pumping. Flushing fluid (such as sealing water or substantially fiber-free foam) is introduced into a clearance between the rotors and the interior surface of the second end of the casing to keep the clearance substantially free of undesirable particles or fibers, typically fibers (such as glass fibers) having greater abrasiveness than cellulose fibers, or fibers (such as synthetic fibers, or synthetic material coating cellulose fibers) having poorer heat resistance than cellulose fibers. The flushing fluid may be introduced into the clearance in a number of different ways as long the clearance is kept substantially free of the undesirable particles or fibers. The flushing fluid is introduced, preferably through a check valve, at a pressure at least slightly higher than the output pressure of the pump.

23 Claims, 2 Drawing Sheets

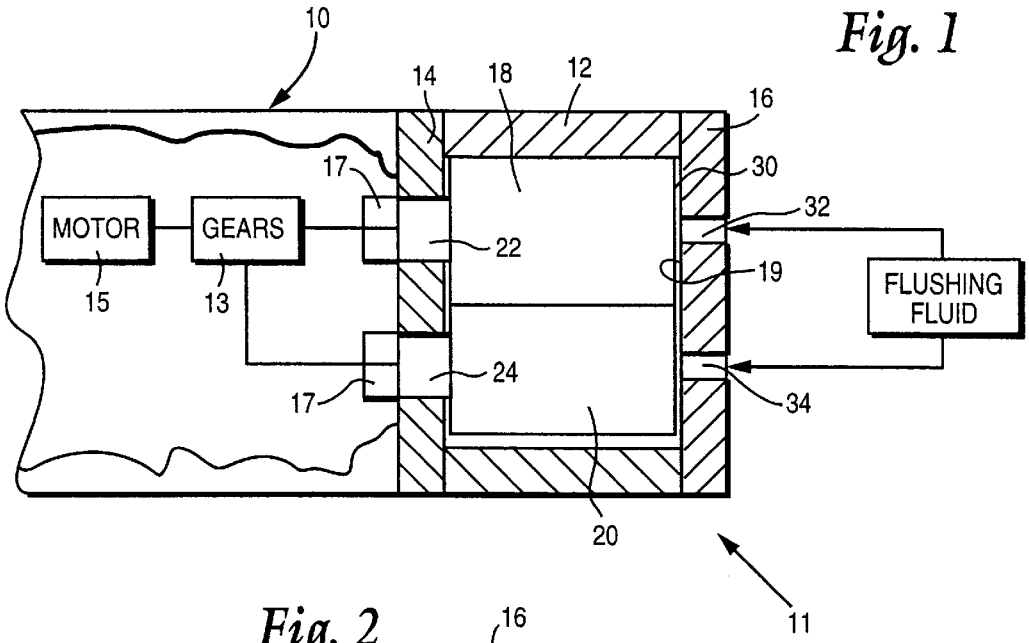
Fig. 1
Fig. 2
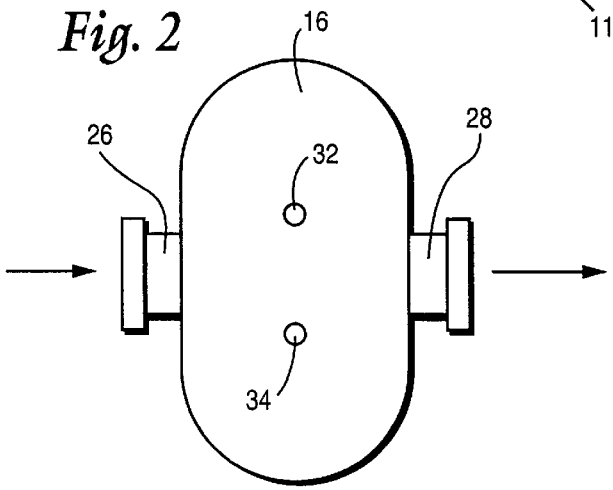
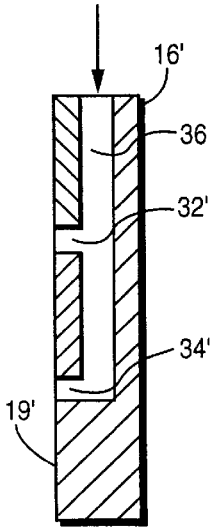
Fig. 3
Fig. 4
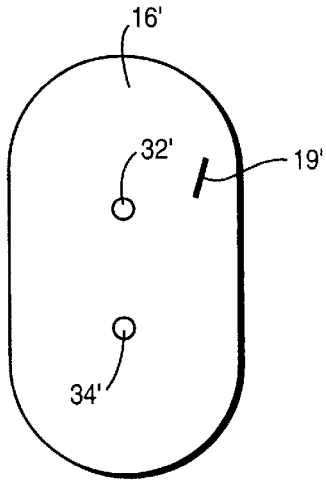

*Fig. 5*
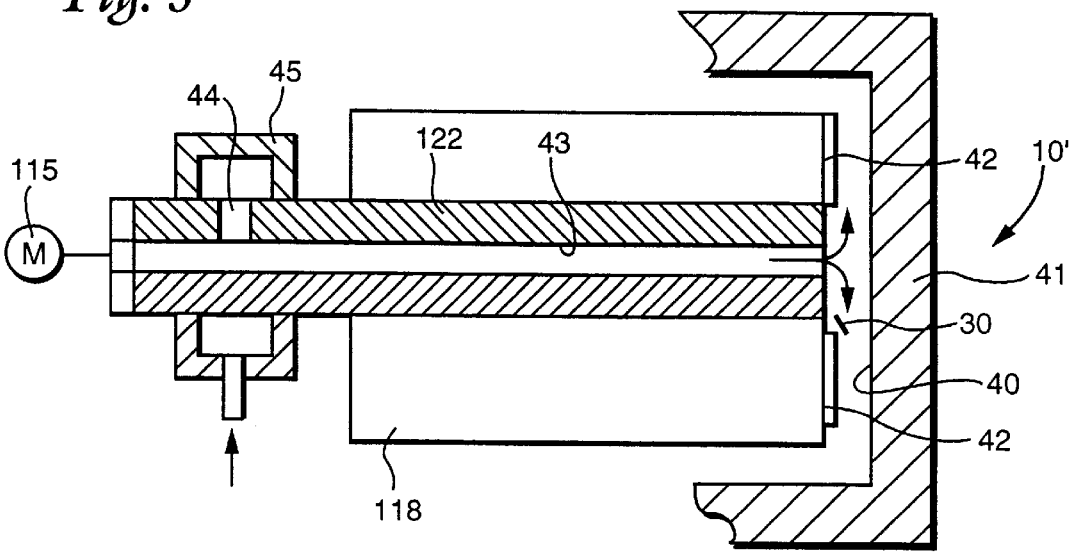
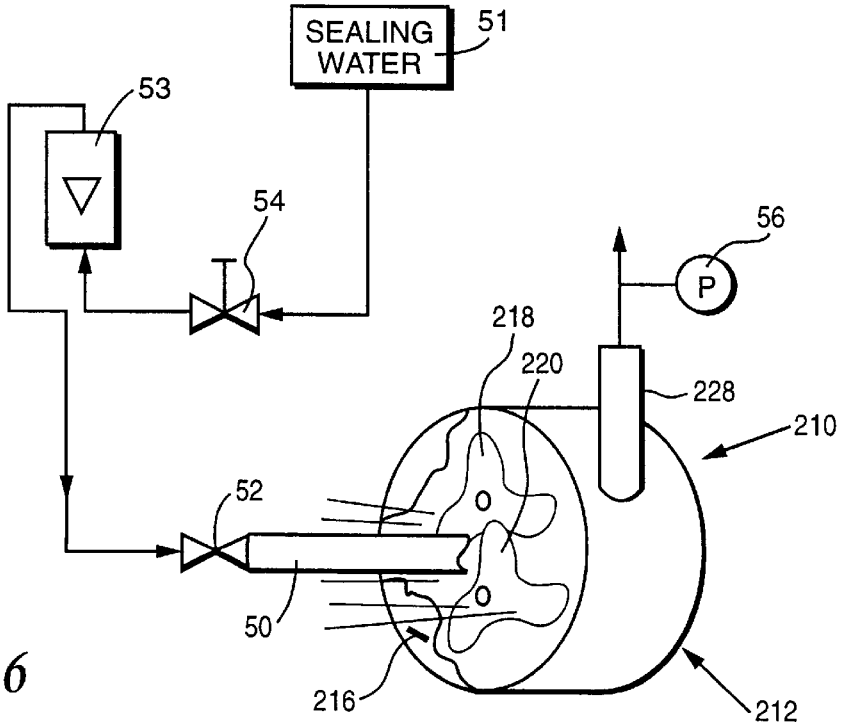
*Fig. 6*

DISPLACEMENT PUMP AND METHOD OF USE THEREOF

BACKGROUND AND SUMMARY OF THE INVENTION

The present invention relates to a displacement pump, to a method of improving the operation thereof, and to the use of the displacement pump. The pump in accordance with the invention is particularly well suited for use in locations where relatively high pressure level performance is required of the pump and where the material to be pumped is problematic (e.g. the material being pumped may be particularly erosive or corrosive, or the heat resistance of the material may be poor). It is especially advantageous to use the displacement pump in accordance with the invention for pumping cellulosic fiber suspensions, synthetic fiber suspensions, and glass fiber suspensions in the pulp and paper industry and particularly in the manufacture of non-woven webs by the water-laid, or foam processes (e.g. see copending application Ser. No. 08/923,900 filed Sep. 4, 1997.

It is known from the prior art to pump cellulosic fiber suspensions, synthetic fiber suspensions, and glass fiber suspensions, either with a centrifugal pump or a displacement pump. The type of the pump is chosen primarily depending upon the consistency of the pulp slurry to be pumped, and/or the pressure level performance required of the pump. When, for instance, the pressure level performance required of a pump is so high that it cannot be reached with a centrifugal pump, a displacement pump—such as a rotary-lobe pump or a gear pump—is then normally used. Prior art pumps for this purpose are shown, for example, in the following U.S. Pat. Nos. 4,621,994; 4,913,629; 5,154,149; 5,318,425, and 5,567,140. These pumps normally operate well when they are used to pump clean cellulosic fiber suspensions, in which the fibers are soft and have a good heat resistance properties. Problems arise when pumping synthetic fibers or fibers coated with synthetics, e.g. with acrylic. One problem is gradual increasing consumption of power of the pump motor, and overheating of the pump. If measures are not taken to correct this, the shaft of the pump may break off or at least the safety clutch in the pump may be activated, so that the pump motor keeps on running but the rotor of the pump stands still.

The source of the above mentioned problems is the passage of fibers into the small clearance between the rotor and housing. In order to reach the required pressure level, the clearance between the rotor of the pump and the end surfaces of the pump casing must be kept small. In actual operation this causes the fibers to be pushed and squeezed in and ground between the rotatable rotor and the end surface of the casing. Consequently, the temperature of the fibers rises and synthetic fibers or fiber coatings with poor heat resistance start to melt and stick both to the end surface of the rotor and the interior of the casing. The clearance between the rotor and the casing then narrows further, and this leads to accelerated melting of new fibers or their coatings, and to further blocking of the clearance. In other words, the frictional force, which at first is practically non-existent between the rotor and the end surface of the casing, increases and this leads to increased consumption of power of the pump motor. When the clearance becomes narrower and narrower, the frictional force keeps growing to such an extent that the safety clutch of the pump will be activated, the shaft of the pump will break, or the pump motor will become overheated. In any case the process stops suddenly and time-consuming and expensive repair operations must be carried out.

Another problem typical to pumps of this type arises when the suspension to be pumped contains abrasive fibers, e.g. glass fibers. With glass fibers the problem is the abrasion of the rotor and the end surface of the casing. Because the fibers to be pumped are hard and heat resistant, they do not tend to melt in the clearance but rather cause the end surface of the rotor, or the end surface of the casing, or both, to be ground away, to accommodate the glass fibers. Thus the tightness of the pump is gradually reduced and consequently, the pressure level that can be obtained with the pump decreases substantially until the pump is no longer capable of producing the required pressure level, at which time the pump needs to be repaired.

The above problems, among other factors, exist in all displacement pumps, and particularly the most common pumps for this purpose, rotary-lobe pumps and gear pumps. Such pumps typically consist or comprise a casing and two rotors rotating in opposite directions in the casing. The vanes of the rotors operatively engage each other and thus seal the space between the casing of the pump and the rotor, and also the space between the rotors. There are typically two different types of constructions of these pumps. In the first type the rotors are mounted on bearings in the casing at both ends, e.g. as in U.S. Pat. No. 5,318,415, and in the second type only at the drive end, as in U.S. Pat. No. 4,621,994. Naturally, the construction with bearings at both ends is a more solid construction, but it is also more likely to be damaged because of the bearings at both ends and the sealing which is necessary for the bearings. For this reason pumps with bearings on only one end have gained in popularity.

The problems discussed above are at their worst at the free end of the rotors, where there is no natural flushing available to wash away the fibers from the clearance between the rotor head and the end of the casing of the pump, or to prevent the fibers from reaching the clearance. At the opposite end of the rotors as well as in pumps which have bearings at both ends of the rotors, there is a sealing element at both ends, usually of the stuffing box type, which prevents the fibers from reaching the bearings of the rotors. It is characteristic of pumps of this type that sealing water is directed to the space between the shaft and the sealing element. The sealing water lubricates the space between the bearing and the shaft and also washes away possible impurities. The sealing water is also an excellent flushing liquid for keeping the space between the end surface of the rotor and the end of the casing clean. This is why problems at the end of the rotor with bearings are rare. If they do arise, one may also expect that the seal itself will become damaged as a result of an inadequate flow of sealing water to the sealing element.

The purpose of the present invention is to resolve the above mentioned problems, so that it becomes possible to use a displacement pump to pump suspensions having poor heat resistant fibers, and suspensions having heat resistant but abrasive fibers. Also the invention seeks to increase the reliability of a displacement pump under these circumstances According to one aspect of the present invention a displacement pump is provided, such as a rotary-lobe or gear pump, comprising the following components: A casing having an inlet and an outlet, and including a first end, and a second end remote from the first end, the second end having an interior surface. A plurality of rotors, connected to shafts, mounted within the casing, the shafts extending substantially perpendicularly to the interior surface of the second end of the casing. A bearing mounting each of the shafts adjacent the first end of the casing for rotation about an axis substantially perpendicular to the interior surface of the second end of the casing, and so that a clearance is defined between the rotors and the interior surface of the first end of the casing. A drive operatively connected to at least one of the shafts adjacent the first end of the casing. And, means for introducing flushing fluid into the clearance to keep the clearance substantially free of undesirable particles or fibers.

The means for introducing flushing fluid into the clearance to keep the clearance substantially free of undesirable particles or fibers may be any conventional structure for introducing a fluid flow into a clearance to keep the clearance clean, including conduits, pipes, nozzles, injectors, or the like. One particularly desirable means comprises a fluid-conducting opening extending through the second end of the casing at points at or adjacent a projection of each of the shafts to the second end. Alternatively, where at least one of the shafts has a fluid passageway therein, the means for introducing the flushing fluid may comprise a fluid passageway for transporting flushing fluid from adjacent the first end of the casing to the clearance at the second end of the casing. Alternatively the means for introducing flushing fluid into the casing may comprise a passage in the casing extending generally perpendicularly to the shaft axes of rotation, and at least one opening that opens from the passageway to the clearance. The flushing fluid may be any fluid that can perform the flushing function adequately without significantly adversely impacting on the slurry being pumped. Perhaps the two most desirable flushing fluids are sealing water and substantially fiber-free foam.

The clearance between the tops of the rotors and the inside surface of the casing second end is typically between 0.01–0.5 mm, e.g. between about 0.15–0.35 mm (or between about 0.01–0.25 mm, or between about 0.26–0.5 mm).

While bearings may be provided at both the first and second end of the casing, preferably the bearings mounting the shafts consist of only the bearings adjacent the first end of the casing, the shafts not engaging or mounted in the second end of the casing. If desired, at least one of the rotors may have vanes on the surface thereof adjacent the interior surface of the second end of the casing, for pumping fibers or particles radially outwardly from the clearance. The inlet and the outlet to the casing may be on opposite sides of the casing, with introducing or removing slurry being pumped generally transverse to the shaft axes of rotation.

According to another aspect of the present invention a system for handling the slurry of abrasive or poor heat resistant fibers or particles is provided. The system comprises: A displacement pump comprising: a casing having an inlet and an outlet, and including a first end, and a second end remote from the first end, the second end having an interior surface; at least one rotor, connected to a shaft, mounted within the casing, the shaft extending substantially perpendicularly to the interior surface of the second end of the casing; a bearing mounting the shaft adjacent the first end of the casing for rotation about an axis substantially perpendicular to the interior surface of the second end of the casing, and so that a clearance is defined between the rotor and the interior surface of the first end of the casing; a drive operatively connected to the at least one shaft adjacent the first end of the casing; and means for introducing flushing fluid into the clearance to keep the clearance substantially free of abrasive or poor heat resistance particles or fibers. A source of slurry having abrasive or poor heat resistance fibers or particles connected to the casing inlet. And, a source of flushing fluid operatively connected, including by a flushing fluid conduit, to the means for introducing flushing fluid.

The system further preferably comprises a check valve provided in the flushing fluid conduit to prevent fluid from passing out of the casing through the flushing fluid conduit. The at least one rotor and shaft may comprise two rotors and shafts. The clearance, and the means for introducing the flushing fluid, preferably are as described above. A flow meter and a control valve may be disposed in a conduit between the flushing fluid source and the check valve.

According to another aspect of the present invention a method of pumping a slurry of abrasive or poor heat resistant fibers (such as fibers having greater abrasive properties than cellulose fibers, and having poorer heat resistance than cellulosic fibers), using a displacement pump (such as described above) is provided. The method comprises the following steps: (a) Feeding a slurry of abrasive or poor heat resistance fibers having a consistency of between about 1–50% (e.g. 2–30%, or 5–20%) to the displacement pump. (b) Pumping the slurry with the displacement pump, by rotating the shaft about an axis of rotation so that the rotor contacts the slurry, to pressurize the slurry to a first pressure. And, (c) feeding flushing fluid into the clearance between the rotor and casing second end interior surface at a second pressure, greater than the first pressure, to substantially prevent abrasive or poor heat resistance fibers from building up or having undesirable effects on the rotor or casing adjacent the clearance.

Step (b) may be practiced to pump a fiber-foam slurry to a non-woven web former which produces a non-woven fibrous web, such as described in U.S. Pat. Nos. 3,716,449 and 3,871,952, for example. Alternatively the pump may pump a liquid slurry to a web former, or may otherwise be used in the pulp and paper art.

The method may comprise the further step of determining the amount of flushing fluid added to the clearance so that the affect of the flushing fluid on slurry consistency can be determined. This may be accomplished utilizing a flow meter disposed in a conduit feeding the flushing fluid into the clearance (pursuant to step (c)). Step (c) is typically practiced using sealing water or substantially fiber-free foam, although other suitable flushing fluids may be utilized.

The displacement pump may comprise at least two rotors, in which case step (d) is practiced to rotate both of the rotors at the same time while guiding the shafts with bearings only at the first end of the casing, the shafts and rotors being spaced from the second end of the casing. Step (c) may be practiced in any suitable manner that accomplishes the desired result of keeping the clearance substantially free of abrasive or poor heat resistance fibers or particles. For example step (c) may be practiced by introducing the flushing fluid through the casing second end interior surface in a direction substantially parallel to the axis of rotation. Alternatively where the shaft has a passageway therein extending from adjacent the first end of the casing to the clearance, step (c) is practiced by passing flushing fluid through the passageway from the first end of the casing to the clearance. Where the second end plate has a passageway therein substantially perpendicular to the axis of rotation of the rotor, step (c) may be practiced by feeding the fluid into the passageway, and then from the passageway into the clearance.

It is the primary object of the present invention to provide a longer life displacement pump, related system, and method of pumping a slurry, all designed for use with slurries having fibers or particles more abrasive and with poorer heat resistance than cellulose fibers. This and other objects of the invention will become clear from an inspection of the detailed description of the invention, and from the appended claims.

BRIEF DESCRIPTION OF THE DRAWINGS

FIG. 1 is a side schematic view, partly in cross-section and partly in elevation, of an exemplary displacement pump according to the invention;

FIG. 2 is a top plan view of the pump of FIG. 1;

FIG. 3 is a longitudinal cross-sectional view of a modified form of the pump casing second end portion that may be utilized in the pump of FIGS. 1 and 2;

FIG. 4 is a bottom plan view of the end plate of FIG. 3;

FIG. 5 is a side view, mostly in cross-section but partly in elevation, of another embodiment of a displacement pump according to the invention; and FIG. 6 is a schematic view showing a displacement pump system of another modified form of the present invention.

DETAILED DESCRIPTION OF THE DRAWINGS

A displacement pump 11 according to one exemplary embodiment of the invention is illustrated in FIGS. 1 and 2, and has the same basic construction as in U.S. Pat. No. 4,621,994. The pump 11 comprises a body 10 inside of which are the necessary operating devices, such as (all conventional per se and shown only schematically in FIG. 1) a gear system 13, motor 15, and bearings 17. The pump 11 also comprises a casing 12 having end plates 14 and 16. Operatively connected to the gears 13 and motor 15 are pump rotors 18 and 20, and rotatable shafts 22 and 24 thereof. Depending entirely on the general construction of the pump 11, the end plate 14 may also be a part of the body 10 of the pump 11, and then no separate end plate of the casing 12 is needed. Also, depending on the size of the pump, the casing 12 of the pump 11 may be a part of one end of the pump (cf. U.S. Pat. No. 4,621,994).

Suction and pressure (i.e. inlet and outlet) conduits 26, 28, respectively, for the medium to be pumped are disposed in the casing 12 of the pump 11 on opposite sides thereof, as shown schematically in FIG. 2. In FIG. 1 the shape of the rotors 18, 20 has been illustrated very schematically because the shape may vary considerably from one type of pump to another, and because the specific shape of the rotors is not critical to the invention. Various prior art pumps disclosing several types of rotor shapes are provided in the patents listed above.

What has been illustrated and described so far is well known in the prior art. In the construction of the pump 11 of FIG. 1 the rotors 18 and 20 are mounted on bearings 17 at only one end, i.e. at the drive end, by shafts 22 and 24. Depending on the output pressure level, material to be pumped, and the size of the pump 11, the spacing (clearance 30) of the rotors 18 and 20 from the end plates 14 and 16 of the pump 11 is in the range of 0.01–0.5 mm, e.g. about 0.15–0.35 mm, or about 0.01–0.25 mm, or about 0.26–0.5 mm. That is, for example, the ends of the rotors 18, 20 are spaced 0.01–0.5 mm from the interior surface 19 of casing second end 16. In the construction of FIG. 1, the problems discussed above—namely abrasion, and the melting of the poor heat-resistant material, and the sintering of the material between the head of the rotors 18 and 20 and the end plate 16 of the pump—can be first detected at the right side end of the pump, i.e. the end opposite where the rotors 18 and 20 are mounted by bearings 17. The reason for this is that in conventional constructions there is nothing at this particular end of the pump 11 to prevent the fibers of the suspension being pumped from migrating into the clearance 30 between the rotors 18 and 20 and the end plate 16 of the pump 11.

According to the invention, openings 32 and 34 are either drilled, welded, or the like, during manufacturing of the end plate 16 of the pump 11 at locations that are substantially a projection of the shafts of the rotors 18 and 20. Flushing fluid (e.g. foam, water, etc.) is caused to flow through the openings 32 and 34 to the clearance 30 between the heads of the rotors 18 and 20 and the head plate 16 of the pump 11. Sealing liquid is preferably used as the flushing medium, which in most cases is from the shaft sealing of the rotors 18 and 20 at the other end of the pump 11. The flushing medium is desirably foam when the treatment involves a fiber suspension in which foam is used instead of conventional water. Thus the medium used as the flushing fluid does not significantly disturb the consistency of the suspension.

The pressure of the flushing liquid introduced into openings 32, 34 is kept higher than the pressure in the output conduit 28 of the pump 11, because otherwise it is uncertain whether or not the flushing medium can keep the clearance 30 clean of fibers. It is advantageous to introduce the flushing fluid in such a way that the amount of flushing fluid is measured (dosage delivered with a constant volume pump, for instance) and thus, its effect on the consistency of the fiber suspension can be taken into consideration. Furthermore, it is advisable to have a check valve in the flushing fluid line in case of pressure shocks, so that pressure shocks do not allow the fibers to enter the clearance 30.

Because the openings 32 and 34 preferably are provided at a projection of the shafts 22, 24 of the rotors 18, 20 on the end plate 16 (as described above), it is possible to provide a channel or channels 36 in the modified end plate 16' (having interior surface 19') for example as disclosed in FIG. 3 (viewed from the side of the end plate), or in FIG. 4 (viewed from the inside of the pump). Thus the channel/channels 36 start/s from the level of the outer wall of the casing of the pump and lead to the openings 32', 34'. Furthermore, especially when the flushing fluid is sealing water to be directed to the sealing element at the other end of the pump, the flushing medium can be introduced through a channel drilled through the rotor and its shaft, as described below with respect to FIG. 5.

FIG. 5 shows an alternative embodiment of the significant portions of the pump 10' according to the invention which has one or more rotors 118 and one or more shafts 122. In FIG. 5 structures similar to those in FIG. 1 are shown by the same reference numeral only preceded by a "1". The one or more shafts 122 are driven by a motor 115, or the like, with or without a gear system, and the second end of the casing has an end surface 41 (having an interior surface 40). The rotor or rotors 118 may have vanes 42 (as discussed above) in the portion thereof adjacent the interior surface 40 of the second end 41 of the casing.

In the FIG. 5 embodiment the means for introducing the flushing fluid into the clearance 30 includes a fluid passageway 43 for transporting the flushing fluid from adjacent the first end of the casing (closest the motor 115) to the second end 41. While any suitable conventional structure may be utilized to provide the fluid to the passageway 43, in the schematic embodiment illustrated in FIG. 5 there is a radial opening 44 adjacent the first end of the shaft 122 which is surrounded by a sealed chamber 45 into which the sealing fluid is introduced, and which then flows into the passageway 43 through the radial opening 44. It is necessary that the pressure of the flushing fluid that is supplied to the passageway 43 be greater (although it only need to be slightly greater) than the output pressure from the pump 10, 10' (e.g. the pressure and the outlet 28).

According to another embodiment of the invention, vanes 42 (see FIG. 5) are provided at the end of each rotor 18, 20, and vanes 42—like the vanes of the centrifugal pump—pump fibers entering the clearance 30 radially outwardly. In this embodiment one must make sure that the clearance 30 between the vanes 42 and the end plate 41 is small enough to generate the pressure difference required of the pump 11.

The pump in accordance with the invention can be preferably used in processes where it is necessary to transport fiber suspensions that are difficult to pump. The preferred processes are in the paper and non-woven industries as the feed pumps positioned after pulpers and pulp towers and the feed pumps of the short circulation and the headbox.

FIG. 6 shows a system according to the present invention in which components comparable to those in the FIG. 1 embodiment are shown by the same two digit reference numeral only preceded by a "2". In this embodiment, the rotors 218, 220 are shown as lobed rotors which cooperate with each other, while the casing 212 has a second end 216 opposite the drive end for the rotors 218, 220, and an outlet 228 for the pressurized, pumped, slurry. A conduit 50 penetrates the casing second end 216 at one or more places (in FIG. 6 the penetration being provided only at substantially the center of the casing end 216) for introducing the flushing fluid into the clearance between the rotors 218, 220 in the interior surface of the casing second end 216. The conduit 50 is connected up to a source of sealing water 51, or other flushing fluid (such as substantially fiber-free foam) and a conventional check valve 52 is disposed in the conduit 50, preferably adjacent the casing end 216, to prevent liquid from passing out of the casing 212 through the conduit 50. Also, preferably disposed in the conduit 50 between the source of sealing water 51 and the actual opening of the conduit 50 through the casing end 216, is a flow meter 53, and a control valve 54. By utilizing the flow meter 53 (or a like instrument that can determine the amount of flushing fluid introduced into the casing 212 per unit time) it is possible to calculate the amount of dilution of the consistency of the slurry being pumped by the pump 210, to optionally allow automatic or manual control to keep the consistency within a desired range.

A suitable conventional instrument 56 may be provided in the discharge line connected to the output 228 of the pump 210 for measuring the flow rate of the slurry being pumped and/or the output pressure. The flushing fluid from the source 51 must of course be at at least a slightly higher pressure than that of the discharge from the outlet 228.

Utilizing the displacement pump, and system, as described above, a method of pumping a slurry of abrasive or poor heat resistant fibers (typically having a greater degree of abrasiveness than cellulose fibers—such as glass fibers—and having a poorer heat resistance than cellulose fibers—either synthetic fibers, or a synthetic coating on cellulose fibers) is provided. The method comprises the steps of feeding a slurry of abrasive or poor heat resistance fibers having a consistency of between about 1–50% (e.g. 2–30%, or 5–20%) to the pump 10, 10', 210 (e.g. to inlet 26). Then pumping the slurry with the displacement pump 10, etc., by rotating the shaft(s) 22, 24 about an axis of rotation so that the rotor(s) 18, 20 contact the slurry, to pressurize the slurry to a first pressure. And feeding the flushing fluid into the clearance 30 between the rotor(s) 18, 20, and the casing a second end 16 interior surface at a second pressure, greater than the first pressure, to substantially prevent abrasive or poor heat resistance fibers from building up or having undesirable affects on the rotor(s) 18, 20 or casing (e.g. end plate 16) adjacent the clearance 30.

The method steps may be practiced to pump a fiber-foam slurry to a non-woven web former which produces a non-woven fibrous web as is conventional, and there may be the further step of determining the amount of flushing fluid added to the clearance 30 so that the affect of the flushing fluid on slurry consistency can be determined. This step may be practiced utilizing the flow meter 53 of FIG. 6, for example. The flushing fluid is typically sealing water or substantially fiber-free foam, although other flushing fluids may be utilized.

The rotating step may be practiced to rotate two rotors at the same time while guiding the shafts 22, 24 associated therewith with bearings 17 at only the first end of the casing 12, the shafts 22, 24 and rotors 18, 20 being spaced from the second end 16 of the casing. The introduction of the flushing fluid may be accomplished as illustrated by using the openings 32, 34 in FIGS. 1 and 2, by introducing the flushing fluid into passageway 36 and then the openings 32', 34' as illustrated in FIGS. 3 and 4, through the interior passageway 43 of the shaft 122 of FIG. 5, or through the single conduit 50 adjacent the center of the casing second end 216 as illustrated in FIG. 6, or in any other suitable and/or conventional manner that accomplishes the desired results.

While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures, systems, and methods.

What is claimed is:

1. A displacement pump comprising:

a casing having an inlet and an outlet, and including a first end, and a second end remote from said first end, said second end having an interior surface;

a plurality of rotors, each rotor having a plurality of lobes, connected to shafts, mounted within said casing, said shafts extending substantially perpendicularly to said interior surface of said second end of said casing;

a bearing mounting each of said shafts adjacent said first end of said casing for rotation about an axis substantially perpendicular to said interior surface of said second end of said casing, and so that a clearance is defined between said rotors and said interior surface of said first end of said casing;

a drive operatively connected to at least one of said shafts adjacent said first end of said casing; and means for introducing flushing fluid into said clearance to keep said clearance substantially free of undesirable particles or fibers; and wherein at least one of said rotors has vanes on a surface thereof adjacent said interior surface of said second end of said casing for pumping fibers or particles radially outwardly from said clearance.

2. A displacement pump as recited in claim 1 wherein said clearance is between 0.01–0.5 mm.

3. A displacement pump as recited in claim 1 wherein said means for introducing flushing fluid into said clearance comprises a fluid-conducting opening extending through said second end of said casing at points at or adjacent a projection of each of said shafts to said second end, for introducing flushing fluid substantially directly into said clearance.

4. A displacement pump as recited in claim 3 wherein said clearance is between about 0.15–0.35 mm.

5. A displacement pump as recited in claim 1 wherein said bearings mounting said shafts consist of said bearings adjacent said first end of said casing, said shafts not engaging or mounted in said second end of said casing.

6. A displacement pump as recited in claim 1 wherein at least one of said shafts has a fluid passageway therein; and wherein said means for introducing flushing fluid comprises said fluid passageway for transporting flushing fluid from adjacent said first end of said casing to said clearance at said second end of said casing.

7. A displacement pump as recited in claim 1 wherein said inlet and said outlet are on opposite sides of said casing, and introducing or removing slurry being pumped generally transverse to said shaft axes of rotation.

8. A displacement pump as recited in claim 1 wherein said means for introducing flushing fluid into said casing comprises a passage in said casing extending generally perpendicularly to said shaft axes of rotation, and at least one opening that open from said passageway to said clearance.

9. A system for handling a slurry of abrasive or poor heat resistance fibers or particles, comprising:

a displacement pump comprising: a casing having an inlet and an outlet, and including a first end, and a second end remote from said first end, said second end having an interior surface; at least one rotor, connected to a shaft, mounted within said casing, said shaft extending substantially perpendicularly to said interior surface of said second end of said casing; a bearing mounting said shaft adjacent said first end of said casing for rotation about an axis substantially perpendicular to said interior surface of said second end of said casing, and so that a clearance is defined between said rotor and said interior surface of said first end of said casing; a drive operatively connected to said at least one shaft adjacent said first end of said casing; and means for introducing flushing fluid into said clearance to keep said clearance substantially free of abrasive or poor heat resistance particles or fibers;

a source of slurry having abrasive or poor heat resistance fibers or particles connected to said casing inlet;

a source of flushing fluid operatively connected, including by a flushing fluid conduit, to said means for introducing flushing fluid; and a check valve provided in said flushing fluid conduit to prevent fluid from passing out of said casing through said flushing fluid conduit.

10. A system as recited in claim 9 wherein said at least one rotor and shaft comprises two rotors and shafts.

11. A system as recited in claim 9 wherein said clearance is between 0.01–0.5 mm, and wherein said means for introducing flushing fluid into said clearance comprises a fluid-conducting opening extending through said second end of said casing at a point at or adjacent a projection of said shaft to said second end.

12. A system as recited in claim 9 further comprising a flow meter and control valve disposed between said flushing fluid source and said check valve.

13. A method of pumping a slurry of abrasive or poor heat resistance fibers using a displacement pump having a rotor having a shaft, a drive mounted to the shaft at a first end thereof, and a clearance of between about 0.01–0.5 mm between the rotor and a casing interior end surface adjacent a second end of the shaft, opposite the first end, said method comprising the steps of:

(a) feeding a slurry of abrasive or poor heat resistance fibers having a consistency of between about 1–50% to the displacement pump;

(b) pumping the slurry with the displacement pump, by rotating the shaft about an axis of rotation so that the rotor contacts the slurry, to pressurize the slurry to a first pressure; and (c) feeding flushing fluid into the clearance between the rotor and the casing second end interior surface at a second pressure, greater than the first pressure, to substantially prevent abrasive or poor heat resistance fibers from building up or having undesirable effects on the rotor or casing adjacent the clearance.

14. A method as recited in claim 13 wherein step (b) is practiced to pump a fiber-foam slurry to a non-woven web former, which produces a non-woven fibrous web.

15. A method as recited in claim 13 comprising the further step of determining the amount of flushing fluid added to the clearance so that the effect of the flushing fluid on slurry consistency can be determined.

16. A method as recited in claim 13 wherein step (c) is practiced using sealing water or substantially fiber-free foam.

17. A method as recited in claim 13 wherein step (a) is practiced using fibers having a poorer heat resistance and greater abrasive properties than cellulose fibers.

18. A method as recited in claim 13 wherein the displacement pump comprises at least two rotors, and wherein step (b) is practiced to rotate both of the rotors at the same time while guiding the shafts with bearings only at the first end of the casing, the shafts and rotors being spaced from the second end of the casing.

19. A method as recited in claim 13 wherein step (c) is practiced by introducing the flushing fluid through the casing second end interior surface in a direction substantially parallel to the axis of rotation.

20. A method as recited in claim 13 wherein the shaft has a passageway therein extending from adjacent the first end of the casing to the clearance; and wherein step (c) is practiced by passing flushing fluid through the passageway from the first end of the casing to the clearance.

21. A method as recited in claim 13 wherein the second end plate has a passageway therein substantially perpendicular to the axis of rotation of the rotor, and wherein step (c) is practiced by feeding the fluid into the passageway, and then from the passageway into the clearance.

22. A displacement pump comprising:

a casing having an inlet and an outlet, and including a first end, and a second end remote from said first end, said second end having an interior surface;

a plurality of rotors, connected to shafts, mounted within said casing, said shafts extending substantially perpendicularly to said interior surface of said second end of said casing;

a bearing mounting each of said shafts adjacent said first end of said casing for rotation about an axis substantially perpendicular to said interior surface of said second end of said casing, and so that a clearance is defined between said rotors and said interior surface of said first end of said casing;

a drive operatively connected to at least one of said shafts adjacent said first end of said casing;

means for introducing flushing fluid into said clearance to keep said clearance substantially free of undesirable particles or fibers; and wherein at least one of said rotors has vanes on a surface thereof adjacent said interior surface of said second end of said casing for pumping fibers or particles radially outwardly from said clearance.

23. A system for handling a slurry of abrasive or poor heat resistance fibers or particles, comprising:

a displacement pump comprising: a casing having an inlet and an outlet, and including a first end, and a second end remote from said first end, said second end having an interior surface; at least one rotor, connected to a shaft, mounted within said casing, said shaft extending substantially perpendicularly to said interior surface of said second end of said casing; a bearing mounting said shaft adjacent said first end of said casing for rotation about an axis substantially perpendicular to said interior surface of said second end of said casing, and so that a clearance is defined between said rotor and said interior surface of said first end of said casing; a drive operatively connected to said at least one shaft adjacent said first end of said casing; and means for introducing flushing fluid into said clearance to keep said clearance substantially free of abrasive or poor heat resistance particles or fibers;

a source of slurry having abrasive or poor heat resistance fibers or particles connected to said casing inlet;

a source of flushing fluid operatively connected, including by a flushing fluid conduit, to said means for introducing flushing fluid; and wherein said means for introducing flushing fluid into said clearance comprises a fluid-conducting opening extending through said second end of said casing at a point at or adjacent a projection of said shaft to said second end.

* * * * *